United States Patent [19]

Yoneda

[11] Patent Number: 4,461,228

[45] Date of Patent: Jul. 24, 1984

[54] SEWING MACHINE FRAME CONSTRUCTION

[75] Inventor: Yoshihide Yoneda, Hirakata, Japan

[73] Assignee: Maruzen Sewing Machine Co., Ltd., Osaka, Japan

[21] Appl. No.: 388,398

[22] Filed: Jun. 14, 1982

[30] Foreign Application Priority Data

Jun. 16, 1981 [JP] Japan ..... 56-89211

[51] Int. Cl.[3] ..... D05B 73/00

[52] U.S. Cl. ..... 112/259; 112/184

[58] Field of Search ..... 112/259, 202, 260, 221, 112/191, 193, 235, 184

[56] References Cited

U.S. PATENT DOCUMENTS 1,529,312 3/1925 Hughes, Jr. ..... 112/259
4,060,045 11/1977 Vahle ..... 112/235

FOREIGN PATENT DOCUMENTS 3007206 9/1980 Fed. Rep. of Germany ..... 112/259
2379638 10/1978 France ..... 112/221
1233998 6/1971 United Kingdom .

*Primary Examiner*—Werner H. Schroeder
*Assistant Examiner*—Andrew M. Falik
*Attorney, Agent, or Firm*—Flynn, Thiel, Boutell & Tanis

[57] ABSTRACT

A sewing machine having a underbed hook rotatable in a horizontal plane includes a needle bar tilted at an angle with respect to a vertical line to displace a sewing needle rearward to a retracted position. The retracted needle provides on a bed of the sewing machine a relatively large working surface on which sewing can be effected. The hook is also displaced rearward below the bed for coaction with the needle.

7 Claims, 5 Drawing Figures

SEWING MACHINE FRAME CONSTRUCTION

FIELD OF THE INVENTION

The present invention relates to a sewing machine designed for effecting an easy sewing operation.

BACKGROUND OF THE INVENTION

Sewing on a sewing machine normally requires that the operator hold a piece of cloth being sewn in front of a sewing needle to slightly push the cloth in a direction of feed by hand on a bed of the sewing machine so that the piece of cloth will be guided to form a desired line of stitches thereon. The above cloth guiding operation is however difficult to carry out on a portable sewing machine since the latter has a relatively small bed which has only quite a small area available for the operator to guide the cloth thereon in front of the sewing needle. The difficulty can be overcome by either providing an enlarged bed extending toward the operator or attaching an auxiliary bed. These proposals are disadvantageous, however, in that the bed then projects toward the operator and interferes with sewing operation. Furthermore, the enlarged bed needs a relatively large or bulky casing for housing the sewing machine. The auxiliary bed is required to be attached and detached each time the sewing machine is used and stored.

The working surface on the bed could be increased, without accompanying an increase in the size of a sewing machine, by displacing stitch forming mechanisms such as a hook and a sewing needle rearward or downstream in a direction of feed of a piece of cloth to be sewn. While a space could be available for the rearward displacement of the hook in the bed on a sewing machine with a horizontally rotatable hook which is disposed in front of a sewing needle, the arm and head of the sewing machine lack sufficient space for displacing a needle bar drive mechanism rearward. Displacing the needle bar drive mechanism rearward requires the stitch forming mechanisms to undergo a large design change. A sewing machine in which a hook is located behind a sewing needle has no space available for the hook to be brought into a retracted position.

In addition to the rearward displacement of the hook, a stand on the sewing machine bed could be tilted backward to displace the arm and head rearward to increase the working surface on the bed. However, the center of gravity of the sewing machine would then be shifted backward, rendering the sewing machine less positionally stable and susceptible to vibrations due to the inertia of the moving parts.

SUMMARY OF THE INVENTION

It is an object of the present invention to provide a sewing machine having a horizontally rotatable hook, which has a substantially increased working surface on its bed without increasing the space which the sewing machine takes up and without requiring a large design change of a stitch forming mechanism.

Another object of the present invention is to provide a sewing machine having a head displaced rearward to allow the operator to have a better view of the working surface of the sewing machine.

Still another object of the present invention is to provide a sewing machine having a bed with its working surface slanted downwardly toward the operator to give the operator a wider view of the working surface.

According to the present invention, a needle bar of a sewing machine is tilted backward or downstream in a direction of feed of a piece of cloth to be sewn on the sewing machine, and a hook in a bed is displaced rearward in front of a sewing needle supported on the needle bar. Backward tilting of the needle bar is effected by either supporting the needle bar as tilted on a needle bar support or tilting the needle bar support itself. With the needle bar support being tilted, a head and a needle bar drive mechanism of the sewing machine are also inclined backward to thereby provide a wider range in which the bed working surface is visible for allowing the operator to get a better view of the way in which the piece of cloth is being sewn. The bed working surface may be tilted downward toward the operator to give the latter a wider view of the working surface for easier sewing operation. The tilted working surface should perferably extend in perpendicular relation to the sewing needle as tilted backward. With such an arrangement, the hook can be disposed also in perpendicular relation to the sewing needle, as with an ordinary sewing machine with a horizontally rotatable hook, without requiring any design change of the hook itself.

The above and other objects, features and advantages of the present invention will become more apparent from the following description when taken in conjunction with the accompanying drawings in which certain preferred embodiments of the invention are shown by way of illustrative example.

DETAILED DESCRIPTION

Figure 1:
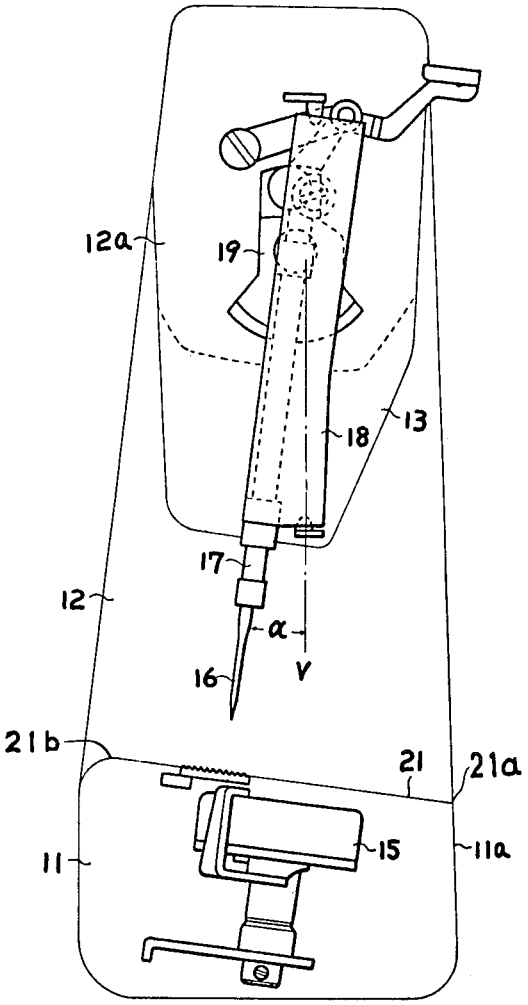
FIG. 1 is a side elevational view of a sewing machine having a horizontally rotatable hook according to the present invention.

As shown in FIG. 1, a sewing machine comprises a bed 11 having a side 11*a* which the operator normally confronts during a sewing operation, a stand 12 mounted on an end of the bed 11 and extending upwardly therefrom, an arm 12*a* extending laterally from an upper end of the stand 12 in an overhanging relation to the bed 11, and a vertically elongate head 13 mounted on a distal end of the arm 12*a* and directed downwardly toward the bed 11. A horizontally rotatable hook 15 is disposed in the bed 21 in front of a sewing needle 16, or closer than the sewing needle 16 to the side 11*a* of the bed 11. The head 13 supports thereon a needle bar support 18 on which there is vertically movably supported a needle bar 17 with the sewing needle 16 mounted on a lower end thereof, and a needle bar drive mechanism 19 for driving the needle bar 17 up and down.

Figure 3:
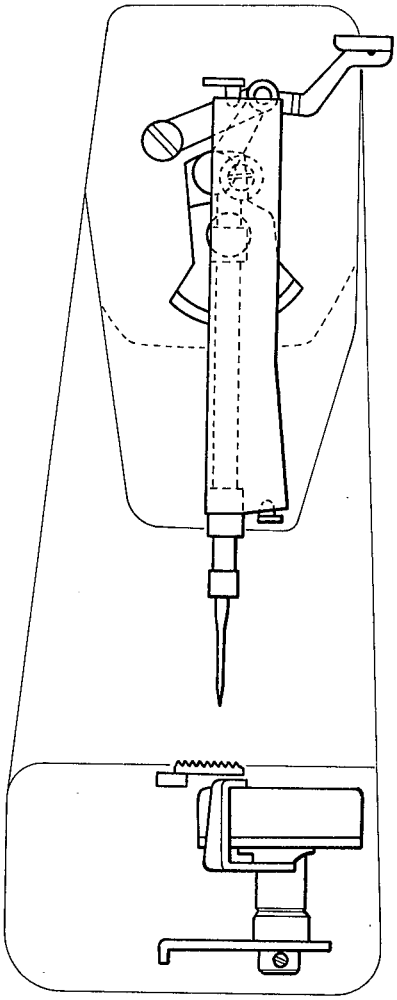
FIG. 3 PRIOR ART
FIG. 3 is a side elevational view of a conventional sewing machine with a horizontally rotatable hook.

The sewing machine shown in FIG. 1 is different from a conventional sewing machine with a horizontally rotatable hook as shown in FIG. 3, in that the head 13 together with the needle bar support 18 and the needle bar drive mechanism 19 is tilted rearward or downstream in a direction of feed of a piece of cloth to be sewn on the bed 11, and the needle bar 17 is also tilted backward downstream in the direction of feed of the piece of cloth at an angle of $\alpha$ with respect to the vertical line V. With this arrangement, the needle 16 is displaced rearward to provide a wider working surface 21 on the bed 11 in front of the sewing needle 16. The hook 15 is also tilted backward about a point around which the needle bar 17 is tilted rearward. Thus, the hook 15 lies in a plane extending in perpendicular relation to the needle 16, or in other words is rotatable about an axis parallel to the needle 16, and is held in the same coacting positional relationship as that in which the needle bar and the hook are disposed as illustrated in FIG. 3 The working surface 21 on the bed 11 is slanted downward toward the side 11*a* or the operator so as to lie parallel to the plane in which the hook 15 is located, or perpendicular to the needle 16, and intersects the side 11*a* along a front edge 21*a*. The planar working surface 21 has a rear edge 21*b*.

Figure 4:
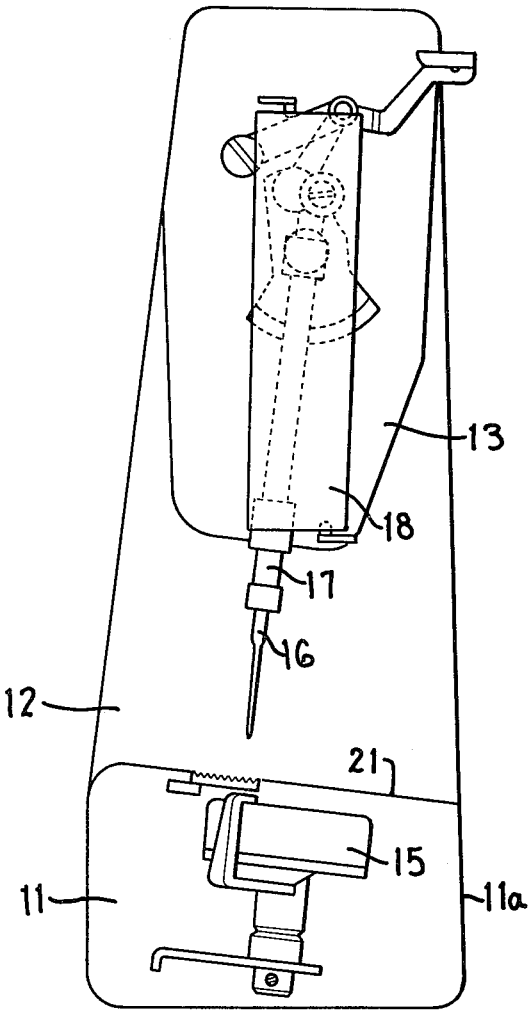
FIG. 4 is a side elevational view of a further alternative embodiment of the sewing machine of FIG. 1.
Figure 5:
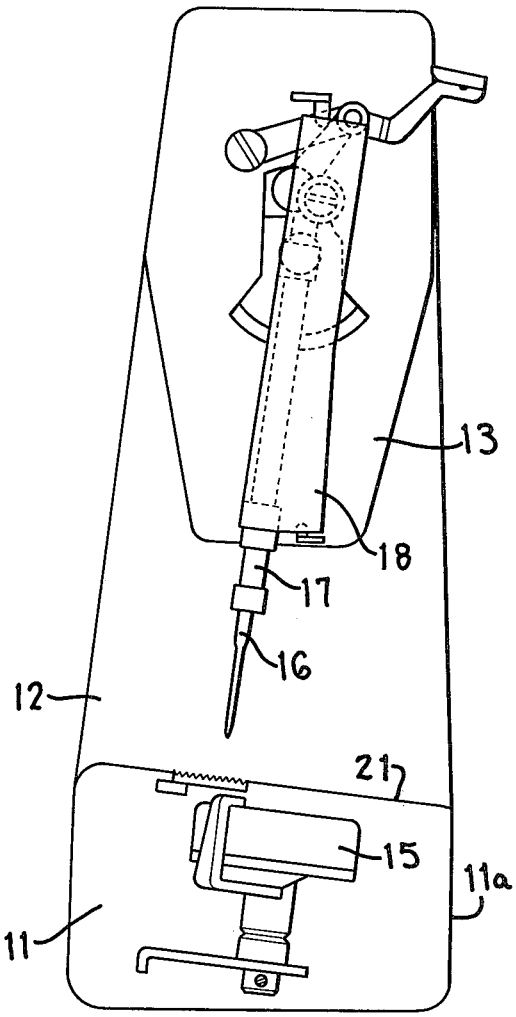
FIG. 5 is a side elevational view of yet another alternative embodiment of the sewing machine of FIG. 1.

The needle bar 17 may similarly be tilted and attached to the needle bar support 18 which remains untilted (FIG. 4). Alternatively, the needle bar support 18 may be inclined to tilt the needle bar 17 with respect to the head 13 which remains untilted (FIG. 5).

Figure 2:
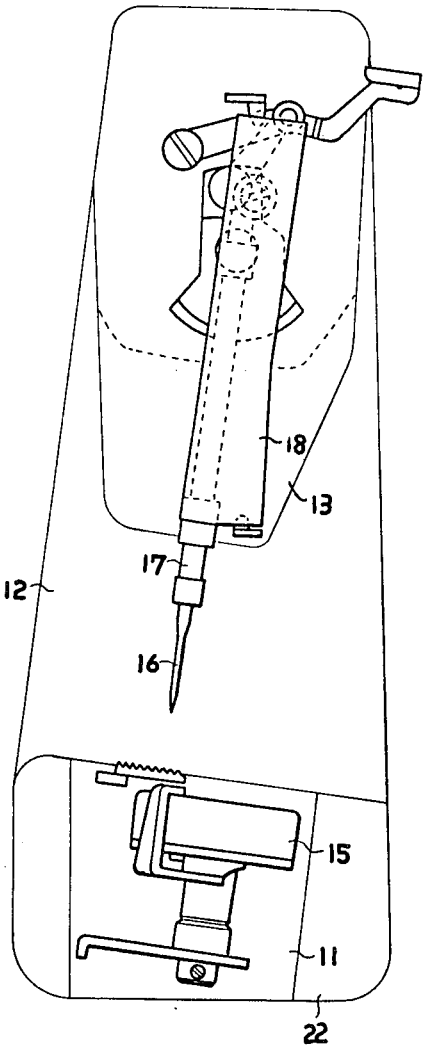
FIG. 2 is a side elevational view of an alternative embodiment of the sewing machine of FIG. 1.

FIG. 2 shows a sewing machine of the free arm type suitable for sewing a cylindrically shaped fabric. The parts of the sewing machine of FIG. 2 are disposed in an arrangement similar to that of the sewing machine shown in FIG. 1. With the hook 15 located in the retracted position, the bed 11 has a space at its front side in which an auxiliary bed 22 can be accommodated neatly without projecting beyond a frame of the sewing machine.

Although certain preferred embodiments have been shown and described, it should be understood that various changes and modifications may be made without departing from the scope of the appended claims.

What is claimed is:

1. A sewing machine, comprising a bed having a generally planar and upwardly facing work surface thereon, said work surface having a front edge which faces a operator of said sewing machine, having a rear edge on a side thereof opposite said front edge, and being adapted to support a piece of fabric for movement in a first direction away from said front edge and toward said rear edge, a hook rotatably supported within said bed below said work surface; a stand supported on and projecting upwardly from said bed at a location which is spaced from said work surface in a second direction generally transverse to said first direction; an arm supported on and extending generally horizontally from an upper end of said stand to a location approximately above said work surface; a head supported on said arm at a location approximately above said work surface; needle support means supported on said head directly above said work surface and movably supporting a needle, said needle extending downwardly and away from said front edge in a third direction which is substantially perpendicular to said work surface and forms an acute angle with respect to a vertical line, said needle being movable in said third direction between a first position in which it is spaced above said work surface and a second position in which it extends through said work surface and is adjacent said hook, the path of movement of said needle intersecting said work surface at a location which is spaced from said front edge thereof and is closer to said rear edge than to said front edge thereof; and means for effecting movement of said needle between said first and second positions.

2. The sewing machine according to claim 1, wherein said hook is supported for rotation about an axis which is substantially parallel to said third direction.

3. The sewing machine according to claim 1, wherein said needle support means includes an elongate needle bar support which extends generally vertically and an elongate needle bar which is supported on said needle bar support for movement in said second direction, said needle being supported on said needle bar and said needle bar being arranged at said acute angle with respect to said needle bar support.

4. The sewing machine according to claim 1, wherein said head is elongate and extends approximately vertically, and wherein said needle support means includes an elongate needle bar support supported on said head and extending approximately in said second direction and a needle bar supported on said needle bar support for movement in said third direction, said needle being supported on said needle bar and said needle bar support being arranged at said acute angle with respect to said head.

5. The sewing machine according to claim 1, wherein said head is elongate, and wherein said needle support means includes a needle bar support supported on said head and a needle bar supported on said needle bar support for movement in said third direction, said needle being supported on said needle bar, and said head and said needle bar support extending approximately in said third direction.

6. The sewing machine according to claim 1, wherein said sewing machine is portable.

7. A sewing machine, comprising a bed having a generally planar and upwardly facing work surface thereon, said work surface having a front edge which faces an operator of said sewing machine and said work surface being adapted to support a piece of fabric for movement in a first direction away from said operator of said sewing machine and sloping upwardly along its entire length in said first direction; a hook rotatably supported within said bed below said work surface; a stand supported on and projecting upwardly from said bed at a location which is spaced from said work surface in a second direction generally transverse to said first direction; an arm supported on and extending generally horizontally from an upper end of said stand to a location approximately above said work surface; a head supported on said arm at a location approximately above said work surface; needle support means supported on said head directly above said work surface and movably supporting a needle, said needle extending downwardly and away from said front edge in a third direction which is substantially perpendicular to said work surface and forms an acute angle with respect to a vertical line, said needle being movable in said third direction between a first position in which it is spaced above said work surface and a second position in which it extends through said work surface and is adjacent said hook; and means for effecting movement of said needle between said first and second positions.

* * * * *